United States Patent [19]

Grisé

[11] Patent Number: 4,667,407

[45] Date of Patent: May 26, 1987

[54] OSCILLATING KNIFE

[76] Inventor: Frederick G. J. Grisé, Box 186, Osterville, Mass. 02655

[21] Appl. No.: 745,193

[22] Filed: Jun. 17, 1985

[51] Int. Cl.[4] ..... B26B 11/00

[52] U.S. Cl. ..... 30/148

[58] Field of Search ..... 30/142, 148

[56] References Cited

U.S. PATENT DOCUMENTS 546,376 9/1895 Barry et al. ..... 30/148
1,585,533 5/1926 Coursen ..... 30/148
3,405,445 10/1968 Canion ..... 30/148
4,131,994 1/1979 Absher ..... 30/148

*Primary Examiner*—Jimmy C. Peters
*Attorney, Agent, or Firm*—Charles R. Fay

[57] ABSTRACT

An orthopedic knife for a one-handed person, the knife comprising a blade, a hold-down member closely associated with the blade, and an extending handle pivoted to both blade hold-down member at spaced points such that the blade reciprocates as the handle is oscillated and the hold-down member is lodged with respect to an object to be cut.

16 Claims, 5 Drawing Figures

OSCILLATING KNIFE

FIELD OF INVENTION

This invention relates to an orthopedic knife for cutting and slicing, especially food, using a single hand only, so that a one-armed person is enabled to cut and slice his food, especially meat, without help from an attendant.

BACKGROUND OF THE DISCLOSURE

Many deformed or injured persons who have a single hand that can be used, tend to resent the help they need in eating, especially in cutting meat; others without resentment would prefer to tend to themselves as much as possible without help. To this end, this invention proposes a tool operable by one hand only and which both anchors food to be cut or sliced, and can be manipulated by the single handed person both in so anchoring the food and in cutting it, without supervision.

SUMMARY OF THE INVENTION

A knife for one handed persons comprising three main parts: a knife blade, a food (or other) hold-down member, and a handle. The hold-down member is elongated and has a point at one end. The blade and member lie side-by-side, with the point on the member adjacent the end or point of the blade, and the sharp edge of the blade and the point face the same way. The other ends of the blade and member are adjacent but spaced in the plane of the blade. The blade and member are independently pivoted to the handle on spaced axes, the axes being spaced in the plane of the blade. The result is that, with the point embedded in the object to be cut, the handle is oscillatable about the axis of the pivot between handle and hold-down member, which is fixed, once the point is embedded. The handle oscillation thus reciprocates the knife against the object to be cut. Means is preferably utilized to press the blade down, and to do the same for the point, so that the food is better held and the knife will cut or slice faster.

The operative relation of the handle and knife is contemplated as taking various forms in one of which the interpivotal relation is such as to recipricate the knife merely through the positioning of the pivot axes, and in another form of the structure the knife is reciprocated by means of a spring in one direction and by a cam action between the handle and knife.

PREFERRED EMBODIMENTS OF THE INVENTION

Figure 1:
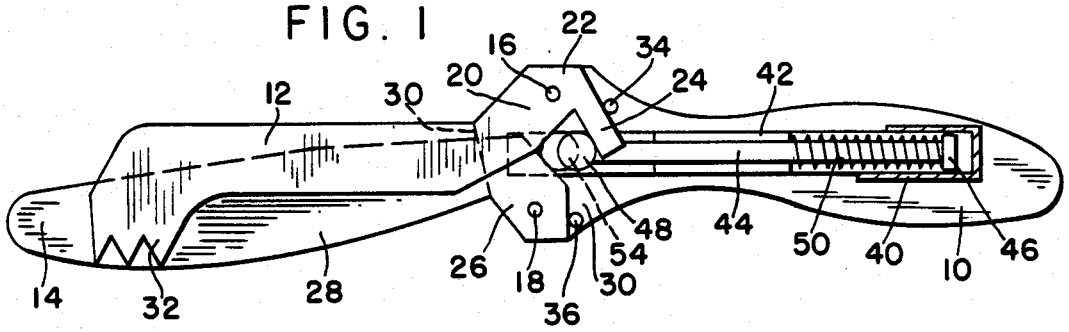
FIG. 1 is an elevational side view of one form of the invention showing the knife at rest, part in section.
Figure 2:
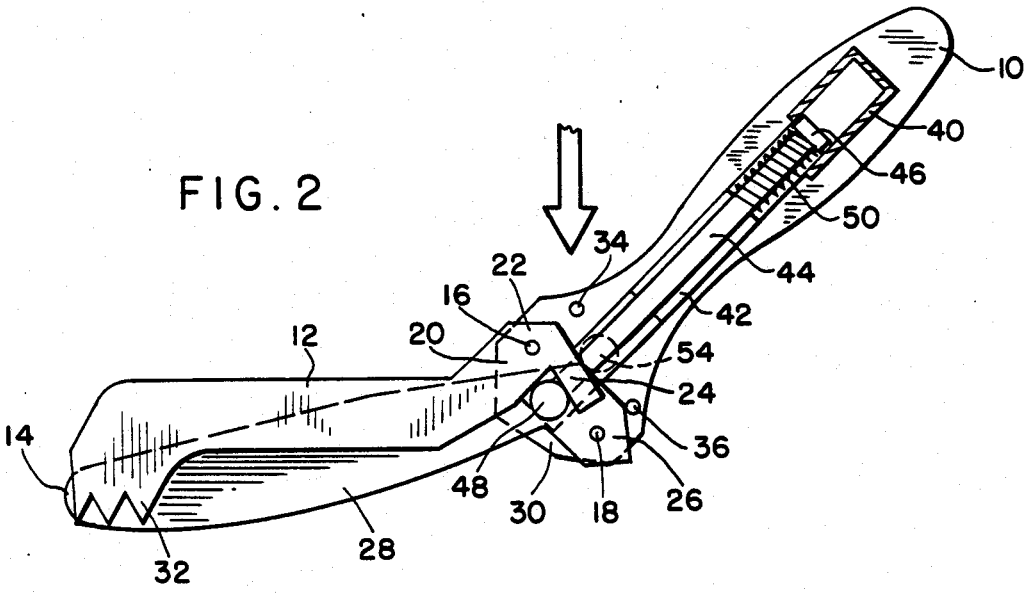
FIG. 2 is a similar view showing the knife in use.
Figure 3:
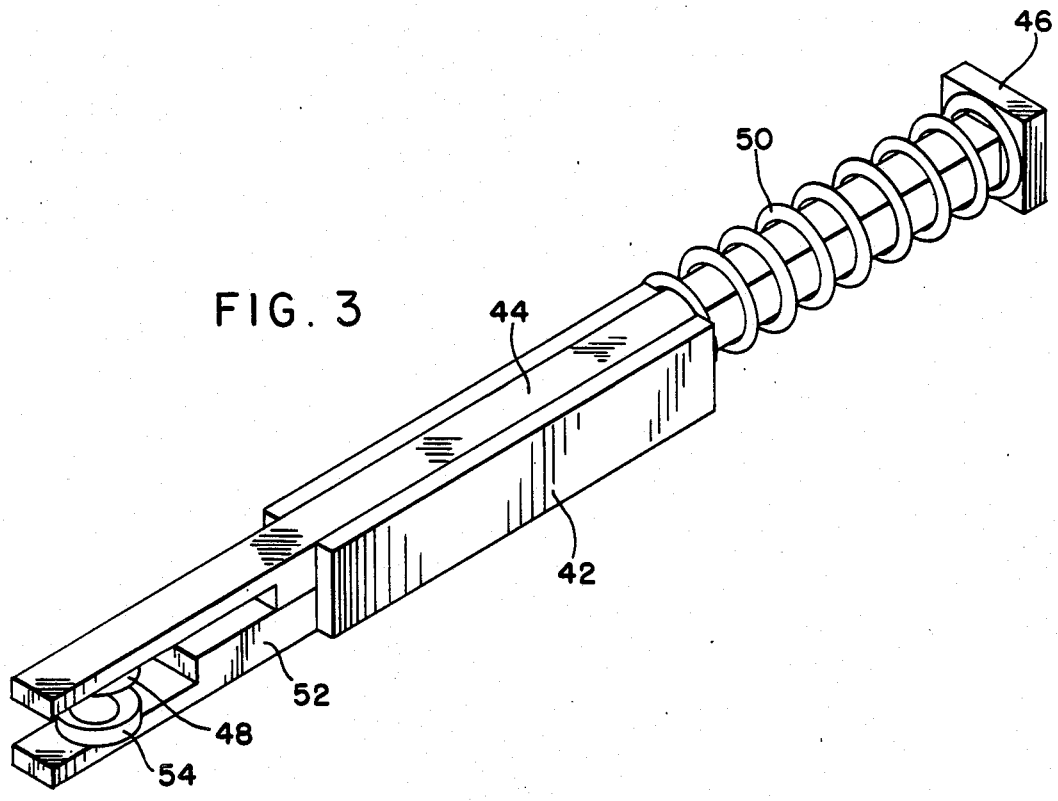
FIG. 3 is a detailed perspective view of the spring and assist.

The orthopedic knife of FIGS. 1-3 comprises three main parts: a handle 10, a hold-down fork 12; and a blade 14. The fork 12 is pivoted to the handle at corresponding ends as at 16, and the blade 14 is similarly pivoted to the handle at 18. The pivot 16 is located in a terminal V shaped offset 20 on the fork, this offset forming an apex portion 22 for the pivot 16 and a tail 24. The pivot 18 is located in an offset 26 in the blade 14 at one end of its sharpened cutting edge 28. Both pivots 16 and 18 are located in an enlarged terminal head 30 of handle 10, these pivots being spaced as shown. The tines 32 on the fork 12 face in the direction of the sharp edge 28 of knife 14 and are located adjacent the free end of the blade. The fork and knife blade may be flat and parallel and ie at one side only of the handle which may be of any convenient shape. Stop pins 24 and 36 on the handle may be used to limit the motion of the blade and fork in an anticlockwise direction relative to the handle.

In use, the hand of the operator thrusts downwardly to embed the tines 32 in the material to be cut or sliced; with the form thus immobilized, the handle is swung or oscillated to reciprocate the blade on the material to achieve the cut in the material. These actions are capable of being accomplished by one hand.

A hollow tubular member 40 is mounted on the handle and houses an elongated bushing 42 that is generally free to reciprocate in the member 40, except as further described. The bushing contains a reciprocable plunger 44 extending out both ends of the bushing 42. This plunger has a head 46 at one end and a roller bearing 48 at its other end. Both head and bearing are outside of the bushing 42 and the plunger is seen to be elongated and longer than the bushing 42, and bearing at one end on the bushing and at the other end on the head 46, there is an expansion spring 50 on the plunger 44 which tends to draw the plunger to the right. The roller bearing 48 bears on the left hand edge of the tail 24 of the fork 12, and thereby the latter is normally urged anticlockwise on its pivot 16 relative to the handle 10 and the tines 32 are thus normally urged downwardly into the material being held by the tines.

The bushing 42 has an extension 52 parallel to and slightly spaced from the plunger 44 at the left hand end thereof, and on this extension is a roller bearing 54 comparable to that at 48 and facing it. Roller 54 bears on the right hand edge of offset 26 at the inner end of knife blade 14 and thus serves to urge blade 14 anticlockwise on pivot 18 relative to handle 10, thereby holding the blade down to the material being cut or sliced, thereby assisting in the latter action while the fork is assisted in holding the material to be cut in place.

Figure 4:
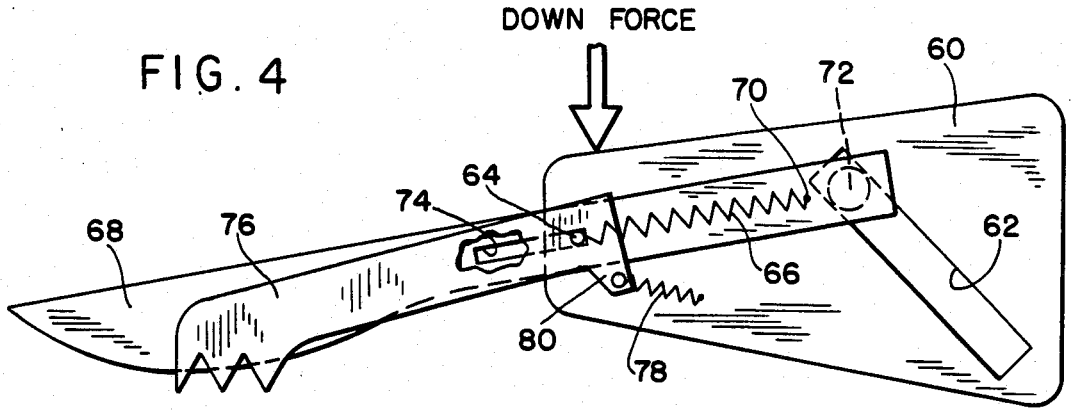
FIG. 4 is an elevational view of a modification.

In FIG. 4, handle 60 has an oblique cam slot 62 and a fixed pin 64. Pin 64 is an anchor for extended spring 66 which is secured to the rear end of blade 68 at 70. Spring 66 pulls the knife to the left. A roller 72 on the knife finds a track in the slot 62 and a slot 74 receiving pin 64 limits the fore and aft motion of the knife. A hold-down fork 76 is pivoted on the pin 64 and has a spring 78 attached to an offset 80 and to the handle 60.

Figure 5:
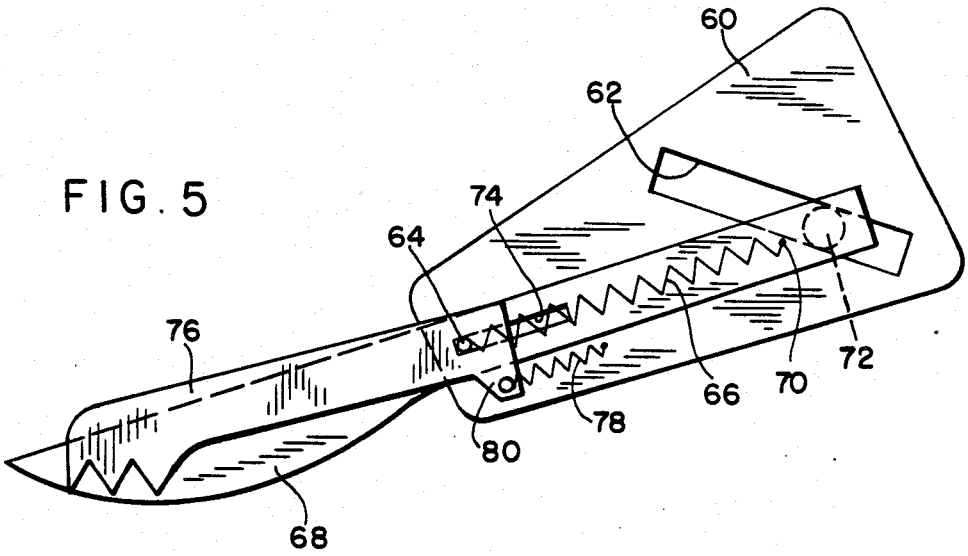
FIG. 5 illustrates the action thereof.

Spring 66 tends to keep the knife pulley up with roller 72 in contact with the cam track 62. As a downward force is exerted per arrow, the roller is forced down the inclined cam track, see FIG. 5, drawing the knife back and energizing the springs. Upon release of the downward pressure on the handle, the spring 66 pulls the knife in the opposite direction. The fork pivots up relative to the handle under the down pressure due to spring 78. The action results in slicing the object, e.g., food, held down by the fork.

I claim:

1. A cutting and slicing tool for one hand operation comprising an edged blade, a member including a point to be embedded in an object to be cut and sliced, and a handle, the blade and member being substantially flat, elongated, parallel, and contiguous and having co-terminous ends, the handle extending from the co-terminous ends and partially overlapping the latter, pivots between the handle and both the blade and the member in the handle-overlapped region thereof, said pivots being separate and spaced means restricting motion of the member relative to the handle in a direction away from the object, and means at least partly on the handle and engaging the blade, said means normally urging the blade toward the object where the point is engaged with the object.

2. The tool of claim 1 including means to urge the point toward the object relative to the handle.

3. The tool of claim 1 wherein the pivot between blades and handle is lower than the pivot between member and handle with the point generally vertically positioned relative to the object, the point being co-planar with respect to the member.

4. A knife for cutting an object and simultaneously holding the object, said knife comprising a blade having a sharp edge, a free end, and a pivot adjacent another end, a holding member, said member being elongated and having a free end, an object-holding point co-planar with and adjacent the free end of the member, and a pivot at another end of the member, a handle, said handle being elongated and having a free end and another end, said pivots being engaged with the handle at said other end thereof, said pivots being spaced, the blade and the member lying in side-by-side relation with the free ends thereof adjacent each other, the pivots being arranged so that the blade reciprocates with the member generally fixed and with the handle partially oscillated about the pivot thereof to the member, and means tending to urge the blade in general in the direction of the point.

5. The knife of claim 4 including means urging the free end and point of the member in the direction of the point.

6. The knife of claim 5 including a single resilient element operating both the blade urging means and the member urging means.

7. The knife of claim 6 including means mounting the resilient element on the handle.

8. A knife for both cutting and holding an object through the use of one hand only, said knife comprising a handle, a knife, and a hold-down, a pin on the handle, a cam slot in the handle, the slot and knife being at angles to each other, a roller on the knife, said roller being located in the slot, a slot in the knife, the pin being located in the knife slot, a tension spring anchored at one end to the pin and at its other end to the knife, the knife and handle being constructed and arranged to retract the knife by means of the roller and cam slot and to move the knife in the other direction by the spring, under pressure on the handle in a pre-determined direction, the retraction of the knife relative to the handle adding greater tension to the spring, the hold-down being pivoted to the handle on the pin, and including an extension spring attached to the handle and to the hold-down at a point offset from the pivot.

9. A knife for one-hand actuation comprising a handle which is generally hollow, a hold down element of generally elongated form, means pivoting said element to the handle adjacent one end of the element, object holding means adjacent to other end of the element, a sharp blade element of generally elongated form, means pivoting the blade element to the handle adjacent one end of the blade element and also adjacent to but spaced from the means pivoting the hold down element to the handle, both elements being free ended at their ends opposite the respective pivoting means, and the object holding means and the sharp edge facing the same direction, a spring in the handle bearing on both elements and urging the hold down element toward hold down position and the blade element toward the object held by the hold down element.

10. A knife according to claim 9 wherein both elements are flat and arranged in side-by-side relation and being swingable with relation to each other upon oscillation of the handle relative thereto.

11. The knife of claim 9 wherein the handle is the sole means to impart a slicing action to the blade.

12. The knife of claim 9 wherein the object holding means includes tines, and the tines and sharp edge of the blade are substantially contiguous.

13. A cutting and slicing tool for one-hand operation comprising:

a. an elongated, flat blade-like hold-down member having at least one tine for embedding in an object to be cut or sliced, said flat blade-like hold-down member having upper and lower longitudinal edges with said at least one tine extending downwardly from said lower edge;

b. a knife blade contiguous with and parallel to said flat blade-like hold-down member having a top edge and a bottom cutting edge;

c. an elongated handle movably connected to said flat blade-like hold-down member and to said knife blade and forming a longitudinal extension thereof;

d. pivot means pivotally connecting said flat blade-like hold-down member and said knife blade to said handle, said pivot means being normal to the blade-like hold-down member and to said knife blade;

e. means associated with said handle, said flat blade-like hold-down member and said knife blade for imparting to said knife blade a predetermined motion relative to the object being cut and to said flat blade-like hold-down member upon oscillation of said handle while the tine of said flat blade-like hold-down member is embedded in an object to be cut or sliced, said latter means including resilient means for biasing said knife blade and said flat blade-like hold-down member to a normal rest position in substantial longitudinal alignment with said handle;

f. and means preventing motion of the flat blade-like hold-down member relative to said handle in a direction opposite the embedding means.

14. The tool of claim 13 wherein said pivot means comprises a first pivot means pivotally connecting said flat blade-like hold-down member to said handle and a second pivot means pivotally connecting said knife blade to said handle, said first and second pivot means being on different axes.

15. The tool of claim 13 wherein said resilient means urges both said flat blade-like hold-down member and said knife blade in the same direction.

16. The tool of claim 13 wherein the handle forms the sole means to impart a cutting action to the blade.

* * * * *